US005542149A

United States Patent [19]

Yu

[11] Patent Number: 5,542,149

[45] Date of Patent: Aug. 6, 1996

[54] CARRIAGE AND RAIL ASSEMBLY FOR A CURTAIN

[76] Inventor: Ching-Jung Yu, 5th Fl., No. 6, Lane 9, Long-Bin Rd., San-Chung, Taiwan

[21] Appl. No.: 262,880

[22] Filed: Jun. 21, 1994

[51] Int. Cl.[6] ..... A47H 5/00; E05D 15/06

[52] U.S. Cl. ..... 16/87.4 R; 16/96 D

[58] Field of Search ..... 16/87.4 R, 87.4 W, 16/87.6 W, 89, 90, 91, 95 R, 95 W, 95 D, 96 D, 96 R, 106

[56] References Cited

U.S. PATENT DOCUMENTS

| | | | |
|---|---|---|---|
| 335,232 | 2/1886 | Moody | 16/106 |
| 926,778 | 7/1909 | Stuyverson | 16/106 |
| 1,692,632 | 11/1928 | Dickey | 16/91 |
| 2,633,088 | 3/1953 | King | 16/106 |
| 3,055,420 | 9/1962 | Del Faro et al. | 16/106 |
| 3,337,903 | 8/1967 | Kenney | 16/87.4 R |
| 3,438,599 | 4/1969 | Welzen | 16/91 |
| 3,580,183 | 5/1971 | Nearman | 16/106 |

*Primary Examiner*—M. Rachuba
*Assistant Examiner*—Donald M. Gurley
*Attorney, Agent, or Firm*—Bacon & Thomas

[57] ABSTRACT

The vertical and horizontal movements of a wheeled carriage mounted for movement along a rail having a pair of inwardly directed lateral rails terminating in a pair of upwardly extending inner edges are limited by providing a first plurality of rollers engaging the bottom surfaces of the transverse rails and a second plurality of rollers positioned for rolling engagement against the inner edges. The axes of rotation of the first rollers are orthogonal to the axes of rotation of the second rollers, and the diameter of each second roller is greater than the width of the carriage portion disposed between the inner edges.

5 Claims, 7 Drawing Sheets

CARRIAGE AND RAIL ASSEMBLY FOR A CURTAIN

BACKGROUND OF THE INVENTION

1. Field of the Invention

The present invention relates to an improved assembly of a carriage and a guiding rail for a curtain, which carriage includes a plurality of vertical and horizontal limiting rollers, the topmost of the vertical limiting rollers being located to contact the bottom of the guiding rail, while the horizontal limiting rollers are provided at both ends and inside of the carriage, so that the vertical and the horizontal components of the force exerted for pulling the curtain can only make the limiting rollers rotate, and thus prevents the guiding rail from distortion, and prolongs the useful life of the guiding rail.

2. Description of the Prior Art

A manually operated curtain A (referring to FIG. 6) is pulled directly to stretch or contract it without using ropes, and a user always catches the front end of the curtain A by hand, or uses a stick, for pulling a carriage B, will the pulling force being a down-ward as well as sideward force relative to the carriage B above the curtain A. To divide the force into vertical and horizontal components, we can find that the force may be a leftward or rightward biasing force and a downward biasing force relative to the carriage B. A conventional carriage for a curtain (FIG. 7) has a pair of rollers 2 on each end of the main body 1 of the sheet carriage, with the rollers 2 being located on both bottom lateral rails 31 of the guiding rail 3 to support the weight of the curtain A and for sliding of the carriage. The bottom lateral rails 31 are folded upwardly to form a pair of inner edges 32, so that the main body 1 is just interposed between the bottom side rails 31 of the guiding rail 3. However, when the curtain is in operation, sideward and forward pulling force render the front and the rear ends of the main body 1 of the carriage to bias leftwardly or rightwardly about a vertical axis (as shown in FIG. 7–1), and render the upper and the lower ends thereof to bias leftwardly or rightwardly about a horizontal axis (as shown in FIG. 7–2), so that in operation of the carriage B, the main body 1 always biases to create sliding friction with the inner edges 32 of the rail 3. The rollers 2 hence are unevenly loaded, and are thereby subjected to damage, breaking, and render it difficult for the user to pull the curtain.

SUMMARY OF THE INVENTION

In view of this, the present invention provides an improved assembly of a carriage and a guiding rail for curtains and overcomes the defects in the conventional carriage.

The main object of the present invention is to provide an improved assembly of the carriage and the guiding rail for curtains, wherein a plurality of vertical and horizontal limiting rollers are provided in addition to the original rollers provided on a conventional carriage. The limiting rollers can render the force creating the biasing phenomenon stated above to only make the carriage slide by rotating of the limiting rollers, and thus the effects of convenient use, smooth sliding and prolonging the useful life of the guiding rail can be achieved.

The secondary object of the present invention is to provide an improved assembly of the carriage and the guiding rail for curtains, wherein the vertical limiting rollers are provided beneath the original rollers, so that the upper and lower sides of the bottom lateral rails can be contacted with the original and the vertical limiting rollers, respectively. Thereby, the force creating biasing of the upper and lower ends of the carriage can be evenly taken by these rollers and limiting rollers, and rotating of these rollers and limiting rollers will render the carriage to slide.

Another object of the present invention is to provide an improved assembly of the carriage and the guiding rail for curtains, wherein the horizontal limiting rollers which are provided at both ends of the carriage can render the force creating the biasing phenomenon stated above to only make the carriage slide by rotating of the limiting rollers when they contact with the inner edges of the bottom lateral rails of the guiding rail, and thus prevents the guiding rail from distortion.

Another object of the present invention is to provide an improved assembly of the carriage and the guiding rail for curtains, wherein the function rendering the force which creates the biasing phenomenon stated above to only make the carriage slide by rotating of the vertical and horizontal limiting rollers provides the carriage with an effect of smooth sliding.

A further object of the present invention is to provide an improved assembly of the carriage and the guiding rail for curtains, wherein the-function rendering the force which creates biasing phenomenon stated above to only make the carriage slide by rotating of the vertical and horizontal limiting rollers provides the carriage with a prolonged useful life.

The present invention will be apparent from, the foregoing detailed description of the preferred embodiment thereof, with reference to the accompanying drawings.

DETAILED DESCRIPTION OF THE PREFERRED EMBODIMENT

Figure 1:
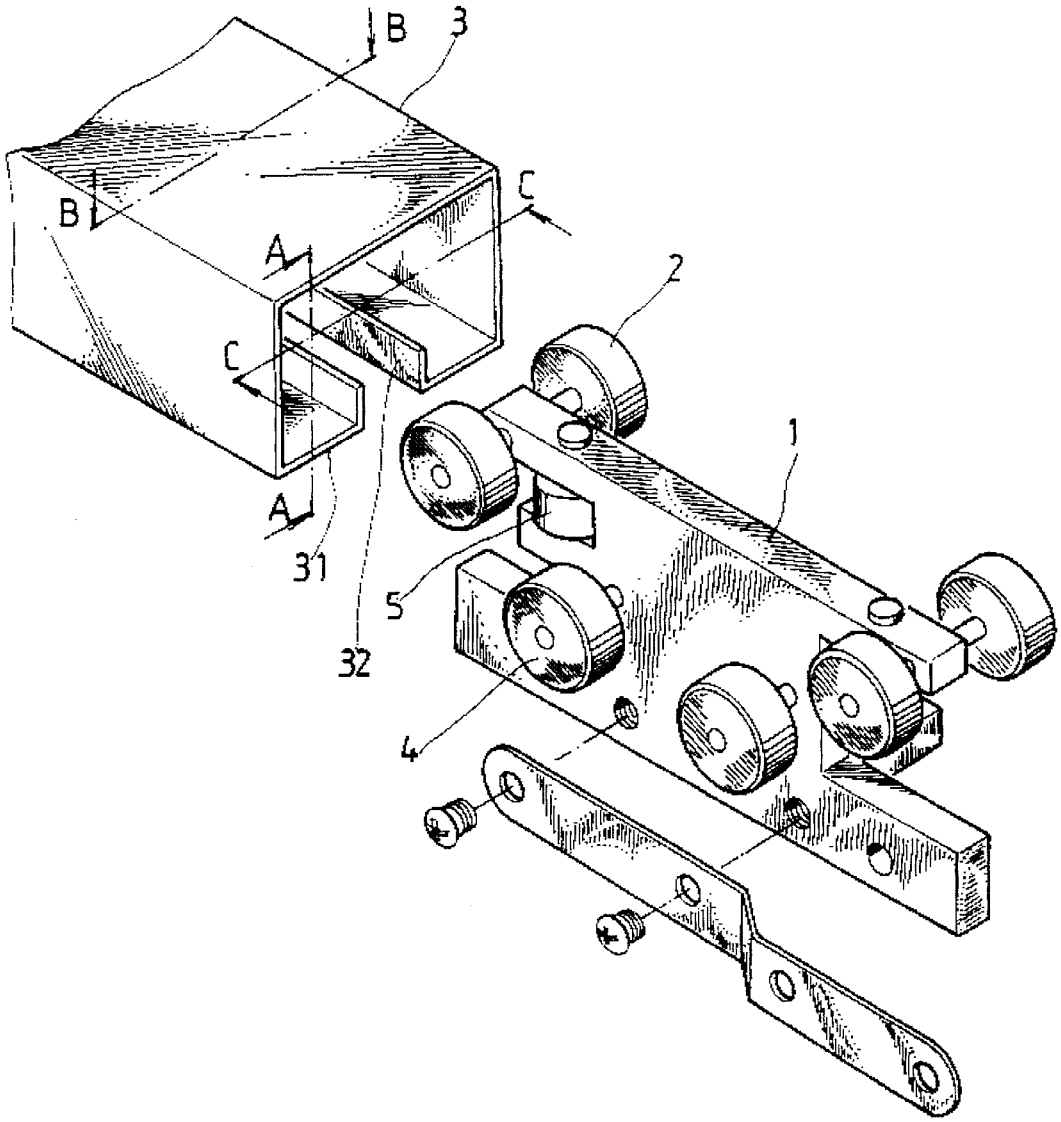
FIG. 1 is a perspective view of the present invention.
Figure 2:
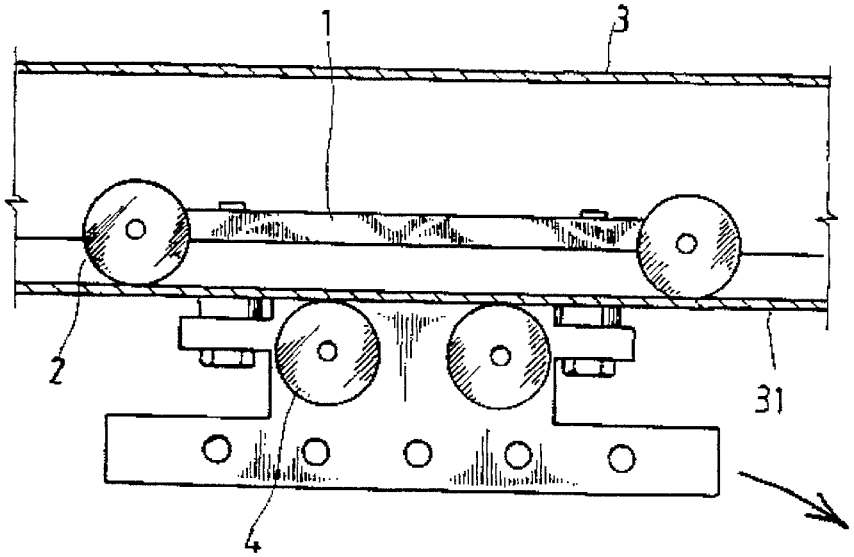
FIG. 2 is a sectional view taken from the sectional line A–A' in FIG. 1 and shows the relative positions of the elements of the present invention.
Figure 3:
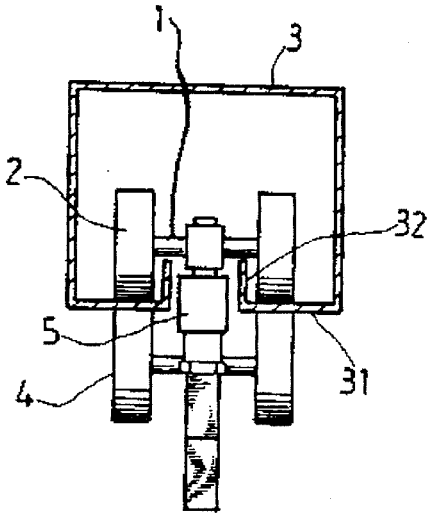
FIG. 3 is a sectional view taken from the sectional line C–C' in FIG. 1 and shows the relative positions of the members of the present invention.
Figure 4A:
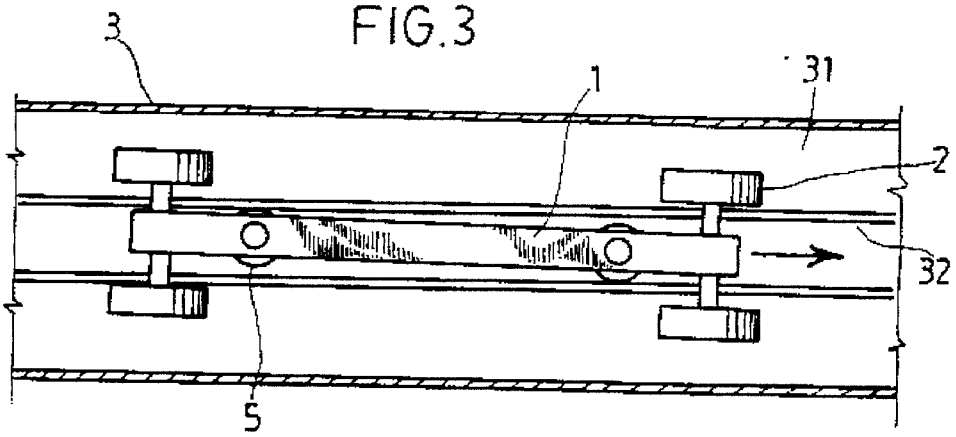
FIG. 4A is a schematic view showing the operation of the present invention.
Figure 3A:
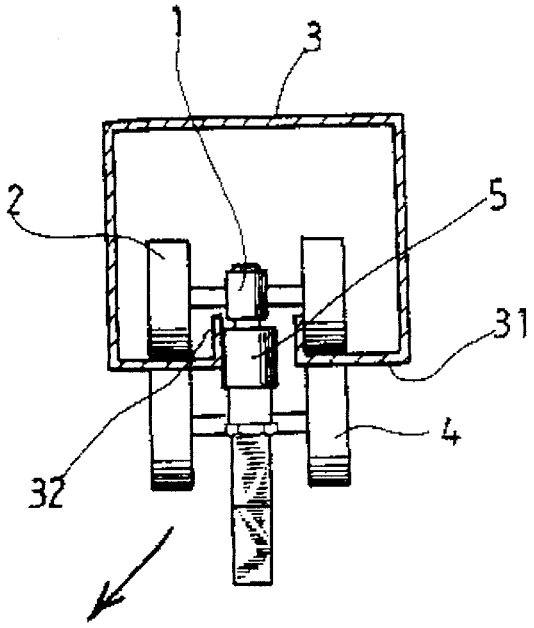
FIG. 3A is a schematic view showing the operation of the present invention.
Figure 4:
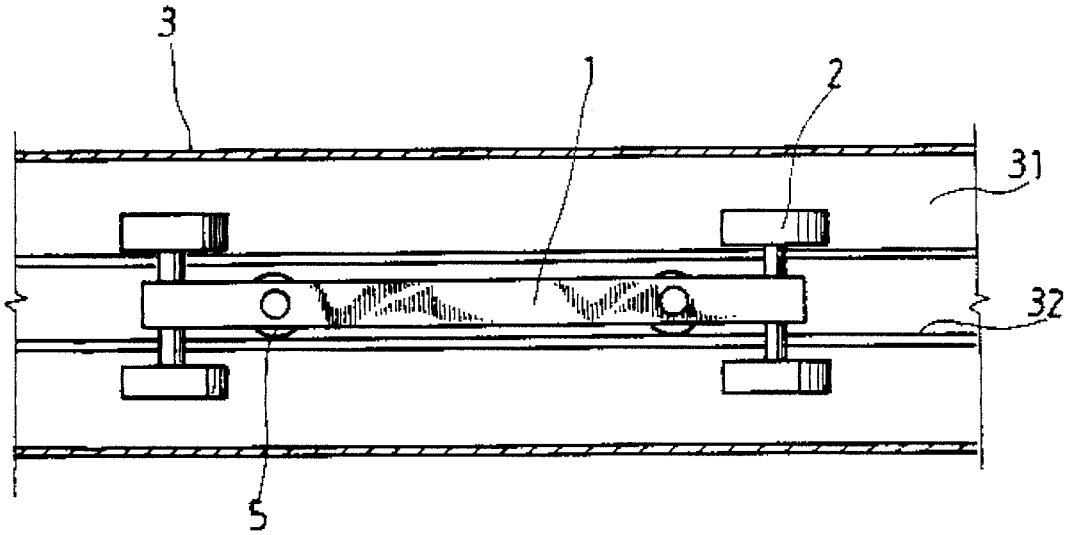
FIG. 4 is a sectional view taken from the sectional line B–B' in FIG. 1 and shows the relative positions of the elements of the present invention.
Figure 6:
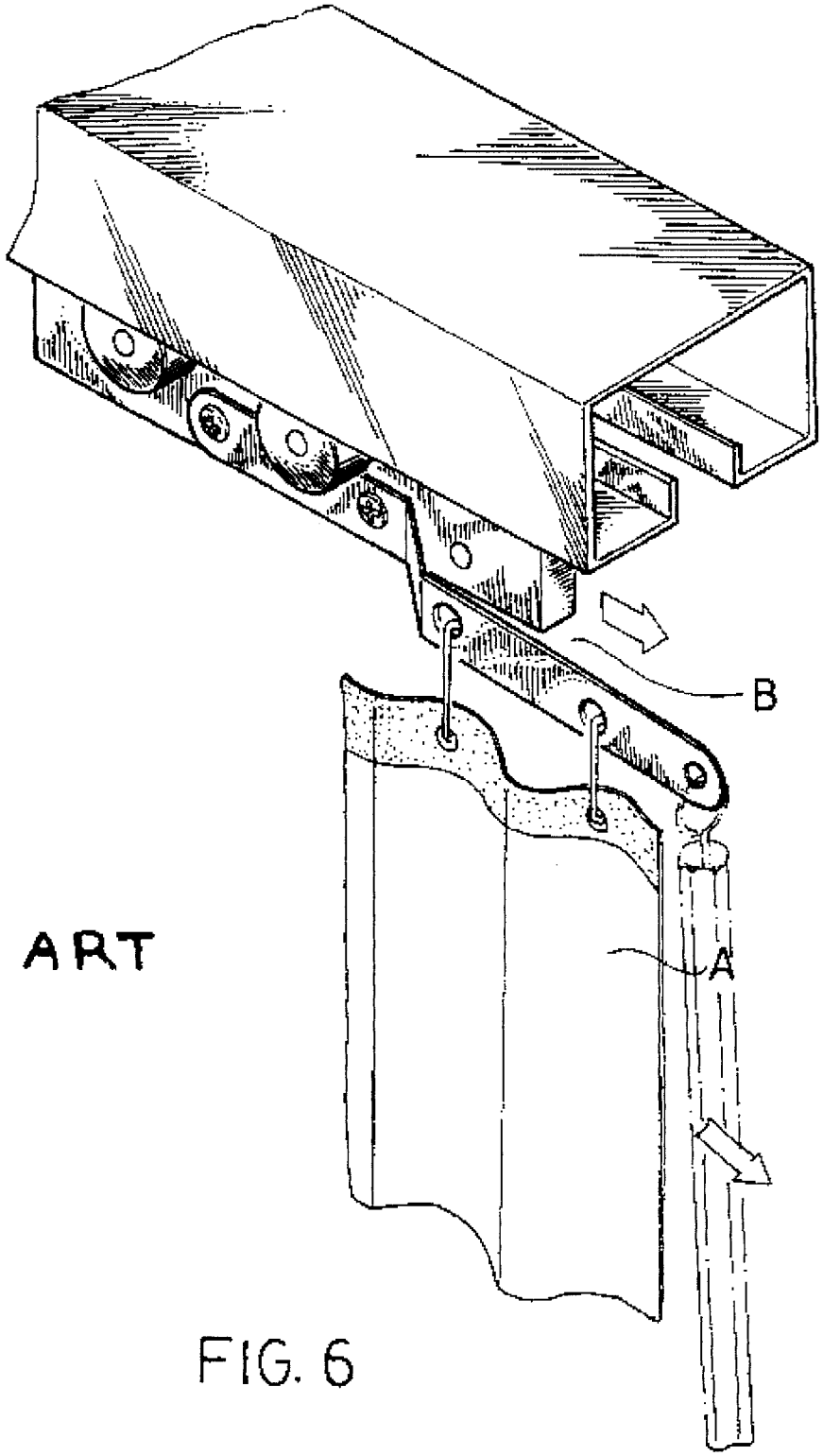
PRIOR ART FIG. 6
FIG. 6 is a schematic view showing a conventional curtain assembly.
Figure 7:
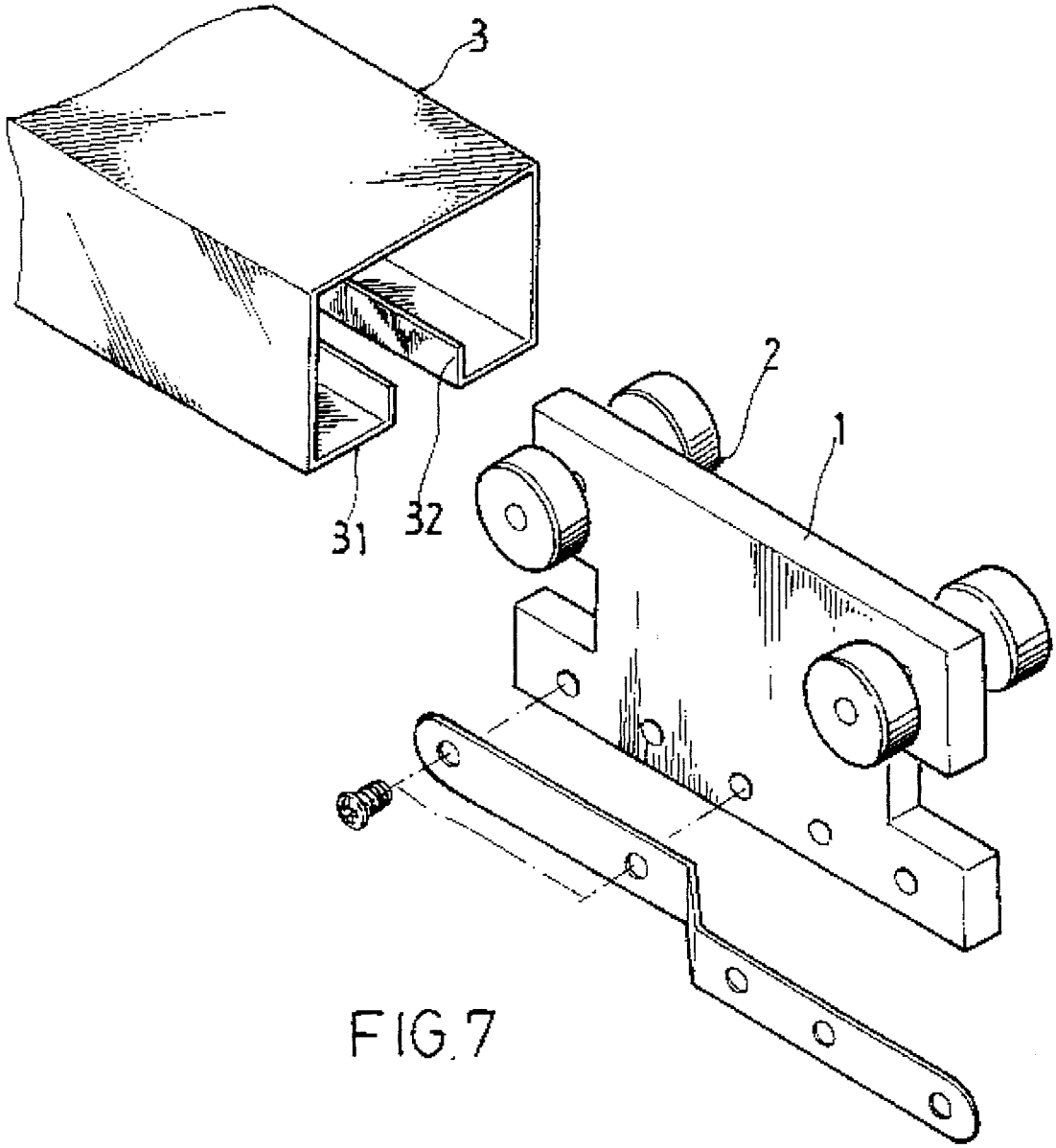
FIG. 7 PRIOR ART
FIG. 7 is a perspective view of the conventional carriage and guiding rail.
Figure 7A:
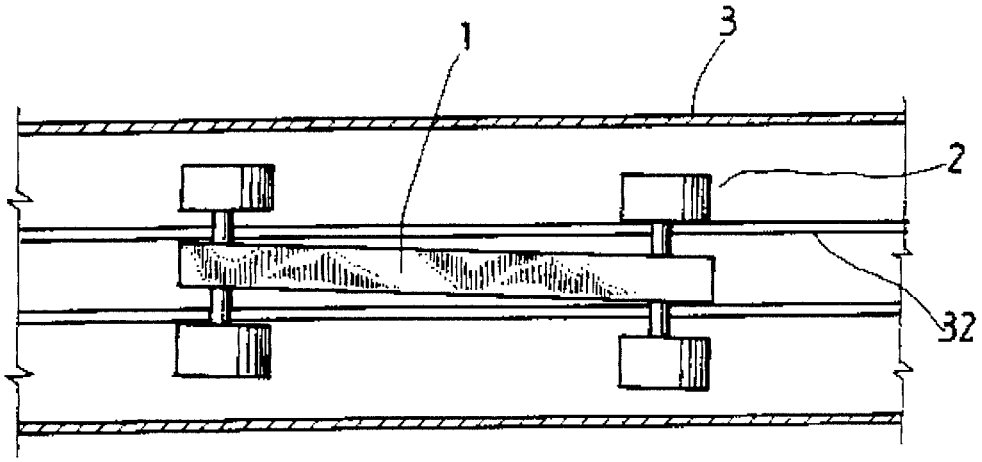
FIG. 7A PRIOR ART
FIG. 7A is a schematic view showing the vertical biasing state of the front and the rear ends of the main body of the conventional carriage.
Figure 7B:
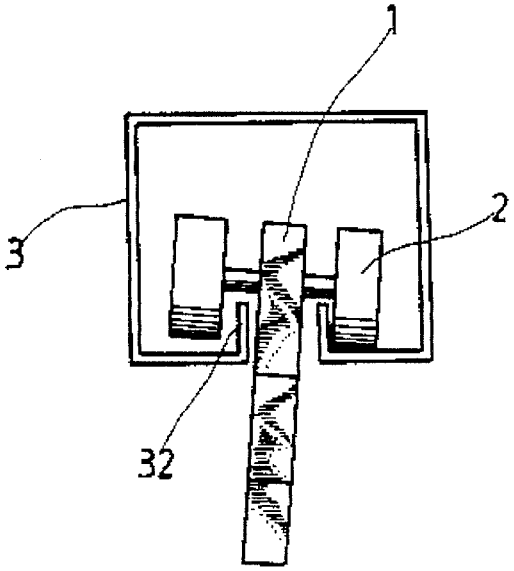
FIG. 7B PRIOR ART
FIG. 7B is a schematic view showing the horizontal biasing state of the upper and the lower ends of the main body of the conventional carriage.

FIG. 1 shows the improved assembly of the carriage and the guiding rail of the present invention for curtains, wherein a plurality of vertical limiting rollers 4 and horizontal limiting rollers 5 are provided, in addition to the rollers 2 on a conventional manually operated curtain assembly, and are provided respectively at the front and rear ends and on both sides of the main body 1 of the carriage. The vertical limiting rollers 4 are provided beneath the rollers 2, i.e., the topmost peripheral edges of the vertical limiting rollers 4 are slightly lower than the bottommost peripheral edges of the rollers 2, and the vertical limiting rollers 4 have the same diameter as that of the rollers 2. The horizontal limiting rollers 5 are provided at the front and rear ends of the main body 1, with their axes being orthogonal to those of the vertical limiting rollers 4, while the diameter thereof is larger than the thickness of the main body 1. The guiding rail 3 for the carriage is formed to have two bottom lateral rails 31, the inner ends of the bottom lateral rails 31 being folded upwardly to form a pair of inner edges 32, so that the main body 1 can be interposed between the bottom lateral rails 31 of the guiding rail 3 as shown in FIG. 2–FIG. 4, wherein FIG. 2 is a sectional view taken from the sectional line A–A' in FIG. 1 and shows the relative positions between the guiding rail 3 and the main body 1. The upper and lower sides of the bottom lateral rails 31 can be contacted with the rollers 2 and the vertical limiting rollers 4 respectively. If a force is applied to the main body 1 on one end thereof, as depicted by the arrow FIG. 2, the horizontal component of the force will render the main body 1 to move horizontally by rotating the rollers 2 and the vertical limiting rollers 4 on the bottom lateral rails 31, while the vertical component of the force will not cause the other end of the main body 1 (which end is not exerted directly by the force) to be raised or displaced, because the two ends of the main body 1 are limited by the rollers 2 and the vertical limiting rollers 4. This the upward or downward biasing phenomenon of the main body 1 can be avoided. FIG. 3 is a sectional view taken from the sectional line C—C in FIG. 1 and shows the relative positions between the guiding rail 3 and the main body 1, wherein the main body 1 and the horizontal limiting rollers 5 are interposed between the inner edges 32 of the bottom lateral rails 31 of the guiding rail 3, while the rollers 2 and the vertical limiting rollers 4 are disposed on and beneath, respectively, the bottom lateral rails 31 which extend inwardly from the outer ends of the bottom of the lateral rails 31, so that the lateral rails 31 are clamped between the rollers 2 and the vertical limiting rollers 4. If a force is exerted as shown by an arrow in FIG. 3A, the horizontal component of the force will render the main body 1 to bias. However, the horizontal limiting rollers 5 are abutted with the left inner edge 32, so that the main body 1 will not contact the inner edge 32; while the vertical component of the force will not render the end of the main body 1 which is not exerted directly by the force to be raised, because the rollers 2 and the vertical limiting rollers 4 on both sides of the main body 1 clamp the bottom lateral rails 31. Therefore, the main body 1 will never contact the guiding rail 3 by exertion of the force. FIG. 4 is a sectional view taken from the sectional line B–B' in FIG. 1 and shows the relative positions between the guiding rail 3 and the main body 1, wherein the main body 1 is interposed between the inner edges 32 of the guiding rail 3. While the rollers 2 are in pairs and disposed at the front end and the rear end and at both sides of the main body 1, they straddle the inner edges 32. If a force is exerted as shown by the arrow in FIG. 4A, the horizontal component of the force will cause the main body 1 to move along the direction of the component, while the vertical component of the force will cause the end of the main body 1 which is not exerted directly by the force to bias toward a direction opposite to that of the component. Because the diameter of the horizontal limiting rollers 5 is larger than the thickness of the main body 1, the biasing at the front or the rear end of the main body 1 will not cause the main body 1 to contact the guiding rail 3 since the front and rear horizontal limiting rollers 5 have already contacted the inner edges 32. Therefore, the force may incline the main body 1, but will not render it to contact the guiding rail 3 in any way. According to the analyses concerning the sections A–A', B–B' and C–C', it can be seen that the main body on the guiding rail 3 will never contact or have friction with the guiding rail 3 by any force from any direction, while the direction of an action force to the main body 1 is limited to the situation as shown by the arrow depicted in FIG. 6, which force is exerted forwardly or backwardly. In this way, the main body 1 of the present invention can be prevented from biasing and distortion, and friction force can be reduced due to the rotational contact between the rollers 2, the vertical and the horizontal limiting rollers 4, 5 and the guiding rail 3,and thus the effects of prolonging the useful life and effecting stable as well as smooth sliding of the main body 1 can be achieved.

Figure 5:
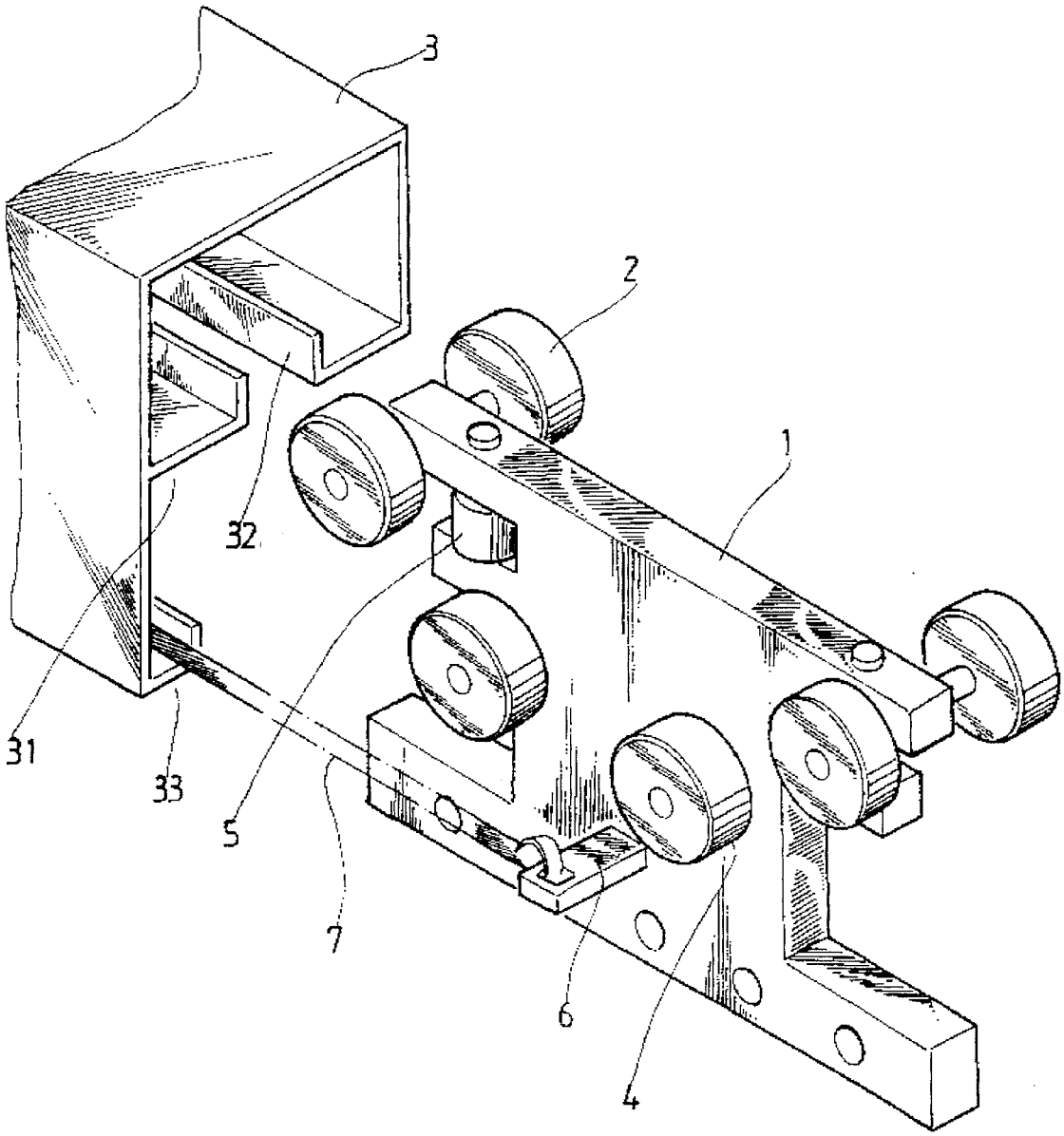
FIG. 5 shows another embodiment of the present invention.

The rollers 2, the vertical limiting rollers 4 and the horizontal limiting rollers 5 are preferably made of plastic or rubber having elasticity, so that they can absorb part of the vertical downward components of force beside the function mentioned above. Moreover, the carriages shown in FIG. 1–FIG. 4 are manually operated carriages, the difference between them and the one using a rope (which is another embodiment of the present invention) resides in that the main body 1 on a rope type carriage for a curtain (referring to FIG. 5) provides a drawing bar 6 which connects to a rope 7, and a guiding channel 33 is provided on one side of and under the guiding rail 3 to allow the rope 7 to move along the guiding channel 33 when the main body 1 is pulled by the rope 7. Because the force applied by the rope 7 is on one side of the main body 1, the rope type carriage also has a possibility of biasing and distortion. However, it can have a stable as well as smooth sliding function by providing the vertical limiting rollers 4 and the horizontal limiting rollers 5.

The invention may assume numerous forms and is to be construed as including all modifications and variations falling within the scope of the appended claims.

I claim:

1. In a carriage and rail assembly for movably securing a curtain, wherein the assembly includes a rail having a pair of inwardly extending lateral rails with top and bottom surfaces and terminating in a pair of spaced upwardly extending inner edges, and the carriage includes a main body having a portion thereof disposed between the inner edges and a plurality of top rollers at opposite ends of the main body in rolling engagement with the top surfaces of the lateral rails for permitting the carriage to be moved back and forth along the rail, the improvement comprising the carriage further including:

a) a plurality of first rollers positioned below the lateral rails for rolling engagement with the bottom surfaces to limit the vertical movement of the carriage, and the axes of rotation of the first rollers being parallel to the axes of rotation of the top rollers; and b) a plurality of second rollers at opposite ends of the main body, the second rollers being positioned for rolling engagement with the inner edges of the lateral rails to limit the horizontal movement of the carriage, the diameter of each second roller being greater than the width of the main body portion between the inner edges, and the axes of rotation of the second rollers being orthogonal to the axes of rotation of the first rollers.

2. The assembly of claim 1 further including:

a) a drawing bar extending outwardly from the main body of the carriage;

b) the rail being provided with a guiding channel; and c) a rope positioned within the guiding channel and having an end connected to the drawing bar for pulling the carriage along the rail.

3. The assembly of claim 1 wherein the first and second rollers are positioned inwardly of the top rollers.

4. The assembly of claim 1 wherein each of the first and second rollers are each formed of plastic or rubber.

5. The assembly of claim 1 wherein the top rollers are spaced from the first rollers at a distance substantially equal to the thickness of the lateral rails.

* * * * *